US010604825B2

(12) United States Patent
Doty

(10) Patent No.: US 10,604,825 B2
(45) Date of Patent: Mar. 31, 2020

(54) ALUMINUM ALLOY CASTING AND METHOD OF MANUFACTURE

(71) Applicant: GM Global Technology Operations LLC, Detroit, MI (US)

(72) Inventor: Herbert W. Doty, Fenton, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 753 days.

(21) Appl. No.: 15/153,402

(22) Filed: May 12, 2016

(65) Prior Publication Data

US 2017/0327929 A1 Nov. 16, 2017

(51) Int. Cl.

| | |
|---|---|
| ***C22C 21/02*** | (2006.01) |
| ***B22D 17/00*** | (2006.01) |
| ***B22D 18/02*** | (2006.01) |
| ***B22D 21/00*** | (2006.01) |
| ***C22F 1/043*** | (2006.01) |

(52) U.S. Cl.
CPC ..... *C22C 21/02* (2013.01); *B22D 17/00* (2013.01); *B22D 18/02* (2013.01); *B22D 21/007* (2013.01); *C22F 1/043* (2013.01)

(58) Field of Classification Search
CPC ..... C22C 21/02; C22C 21/04
See application file for complete search history.

(56) References Cited

U.S. PATENT DOCUMENTS

| | | | | | |
|---|---|---|---|---|---|
| 4,077,810 | A * | 3/1978 | Ohuchi | C22C 21/04 | 148/439 |
| 4,104,089 | A * | 8/1978 | Miki | C22C 21/02 | 148/415 |
| 4,434,014 | A * | 2/1984 | Smith | C22C 21/04 | 148/404 |
| 4,786,340 | A * | 11/1988 | Ogawa | C22C 21/04 | 148/417 |

FOREIGN PATENT DOCUMENTS

| | | | |
|---|---|---|---|
| CN | 101018881 | A | 8/2007 |
| CN | 103540809 | A | 1/2014 |
| JP | S56163246 | * | 5/1980 |

OTHER PUBLICATIONS

Nogita. Effects of Boron-strontium Interactions on Eutectic Modification in Al-10 mass%Si Alloys. Materials Transactions, vol. 44, No. 4 (2003) pp. 692-695 (Year: 2003).*

* cited by examiner

*Primary Examiner* — Matthew E. Hoban

(57) ABSTRACT

An Aluminum-Silicon casting alloy for use in high temperature service conditions. The alloy composition includes, by weight percentage, from about 5.00% to about 17.00% Silicon (Si), from about 0.00% to about 0.90% Iron (Fe), from about 0.00% to about 1.00% Manganese (Mn); from about 0.000% to about 0.018% Strontium (Sr), from about 0.00% to about 2.00% Copper (Cu), from about 0.00% to about 0.50% Magnesium (Mg), from about 0.00% to about 0.05% Zinc (Zn), from about 0.01% to about 0.10% Boron (B); and a balance of Aluminum (Al).

10 Claims, 7 Drawing Sheets

ALUMINUM ALLOY CASTING AND METHOD OF MANUFACTURE

TECHNICAL FIELD

The present disclosure relates to metal casting and more specifically to aluminum alloy compositions and methods of aluminum alloy metal casting.

BACKGROUND

The statements in this section merely provide background information related to the present disclosure and may or may not constitute prior art.

Al—Si based cast aluminum alloys have widespread applications for structural components in the automotive, aerospace, and general engineering industries because of good castability, corrosion resistance, machinability, and high strength-to-weight ratio. Regarding castability, alloy compositions having lower silicon content have been thought to inherently produce poor castings due to a wider freezing range and the reduced latent heat. Alternatively, alloy compositions having higher Silicon content are increasingly difficult to machine and have lower ductility and fracture toughness due to coarser primary silicon particles. In general, aluminum alloy casting performance is based on several factors including alloy composition, casting and solidification conditions, and post-casting process or heat treating.

In attempting to expand or improve the use of aluminum alloys in additional applications that can reap the benefits that aluminum alloys offer, existing aluminum alloy casting composition and processes have fallen short of success in high temperature applications. The overwhelming problem with using aluminum alloy castings in high temperature applications is the tendency for the material to change properties in service. In designing cast parts for such applications, one of the most important aspects of material properties is exactly that the material properties stay unchanged in service. However, to this end currently available commercial aluminum alloys fail to provide such material property stability.

Accordingly, there is a need in the art for an aluminum alloy composition and manufacturing method that has improved initial material properties while maintaining or stabilizing the material properties throughout the service life of the casting in a high temperature application.

SUMMARY

The present invention provides an Aluminum-Silicon based casting alloy and manufacturing process. The casting alloy has a composition including, by weight percentage, from about 5.00% to about 17.00% Silicon (Si), from about 0.00% to about 0.90% Iron (Fe), from about 0.00% to about 1.00% Manganese (Mn); from about 0.000% to about 0.018% Strontium (Sr), from about 0.00% to about 2.00% Copper (Cu), from about 0.00% to about 0.50% Magnesium (Mg), from about 0.00% to about 0.05% Zinc (Zn), from about 0.01% to about 0.10% Boron (B); and a balance of Aluminum (Al).

In another example of the present invention, the composition includes, by weight percentage, from about 7.85% to about 7.90% Silicon and about 0.20% to about 0.30% Iron.

In yet another example of the present invention, the composition includes, by weight percentage, about 0.00% Strontium.

In yet another example of the present invention, the composition includes, by weight percentage, about 0.009% Strontium.

In yet another example of the present invention, the composition includes, by weight percentage, from about 0.40% to about 0.41% Iron and about 0.00% Strontium.

In yet another example of the present invention, the composition includes, by weight percentage, more than about 0.25% Magnesium.

In yet another example of the present invention, the composition includes, by weight percentage, more than about 1.50% Copper.

In yet another example of the present invention, the manufacturing process includes producing a casting by means of one of a sand casting process, a permanent mold casting process, a semi-permanent mold casting process, a high-pressure die casting process, a squeeze casting process, and lost foam casting process.

In yet another example of the present invention, the casting is analyzed to determine an as-cast silicon particle volume fraction, an average silicon particle size, an insoluble intermetallic particle volume fraction, and an insoluble intermetallic average particle size.

In yet another example of the present invention, the casting is solution treated to above an incipient melting temperature by heating the casting to a first temperature for a first period of time, heating the casting to a second temperature for a second period of time, and heating the casting to a third temperature for a third period do time.

In yet another example of the present invention, casting is aged at a temperature between about 150° C. and 190° C. and a time of about 6 to 10 hours.

In yet another example of the present invention, the first temperature is about 495° C. and the first period of time is three hours, the second temperature is about 515° C. and the second period of time is three hours, and the third temperature is about 530° C. and the third period of time is two hours.

The above features and advantages and other features and advantages of the present invention are readily apparent from the following detailed description of the best modes for carrying out the invention when taken in connection with the accompanying drawings.

BRIEF DESCRIPTION OF THE DRAWING

The drawings described herein are for illustration purposes only and are not intended to limit the scope of the present disclosure in any way.

DESCRIPTION

The following description is merely exemplary in nature and is not intended to limit the present disclosure, application, or uses.

As with most metal casting practices and applications, the metal alloy's microstructure has a great effect on the mechanical properties of the material. Specifically addressing Al—Si alloys, the primary casting practices that affect microstructure are solidification rate, chemical impurity modification, and thermal modification during heat treatment. For nearly all compositions, the minimum attained elevated temperature strength, specifically after long term elevated temperature exposure, is higher for parts cast in Al—Si alloys that have not undergone a solution heat treatment. Additionally, higher volume fractions of eutectic Si is another way to retain higher elevated temperature strength. However, both absence of a solution heat treatment and high eutectic Si contribute to lower heat treated and room temperature strength.

Figure 1:
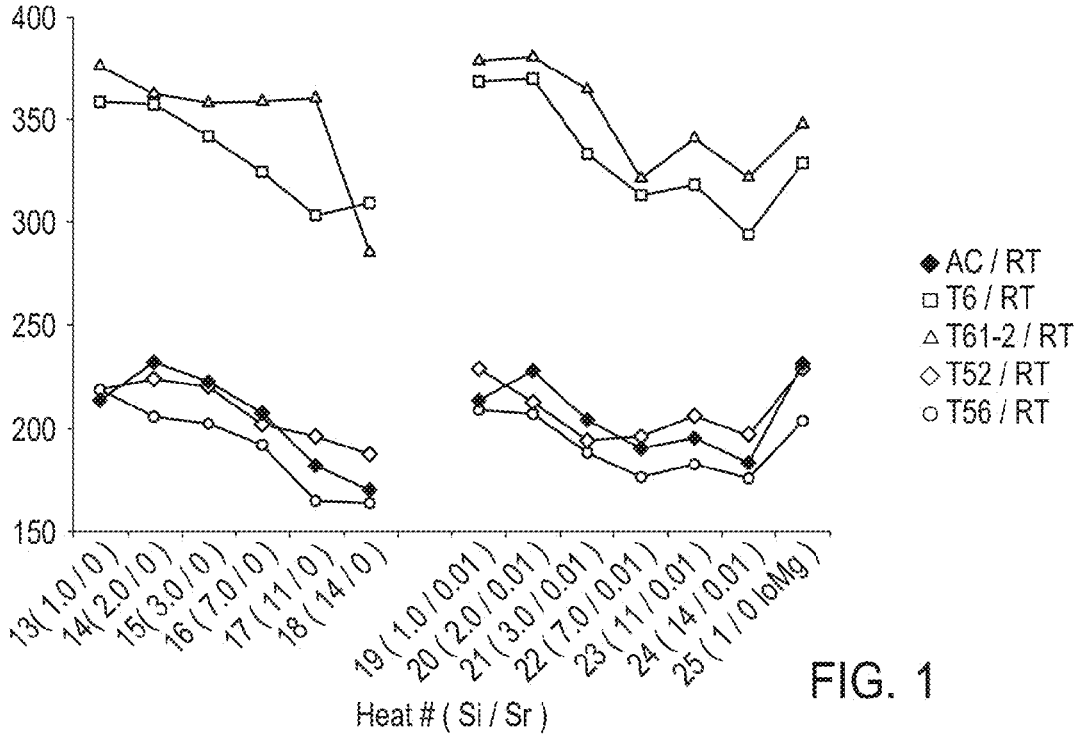
FIG. 1 is a chart displaying room temperature tensile strength for unmodified 319 Al at different heat treatments in accordance with an example of the present invention.
Figure 2:
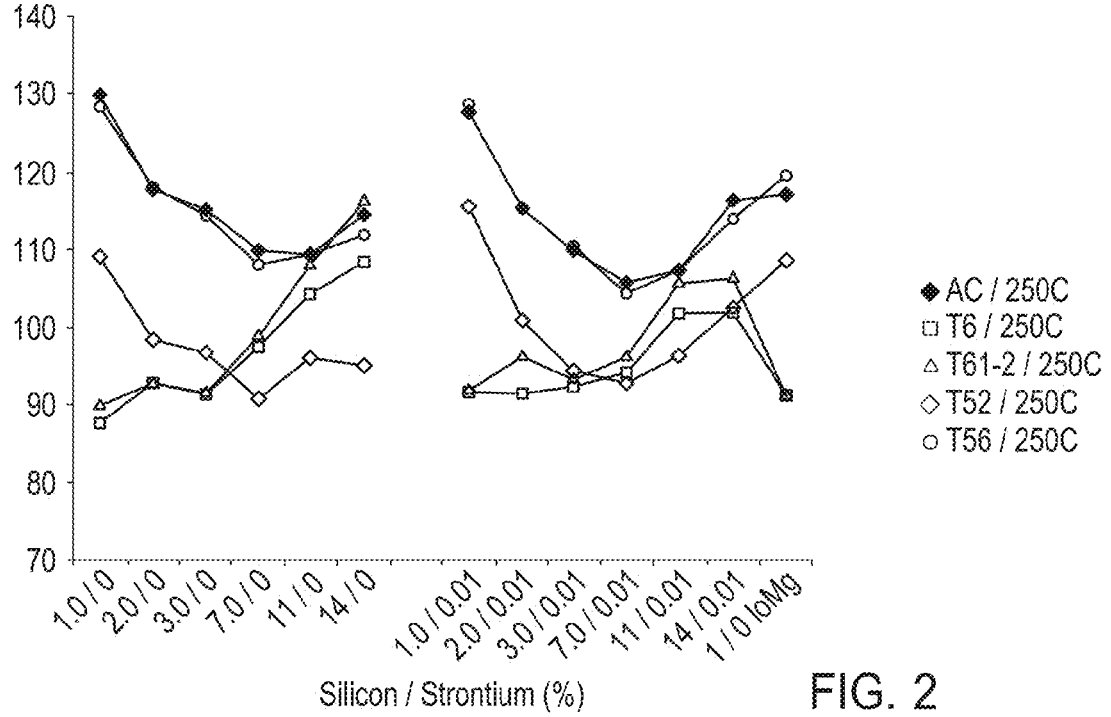
FIG. 2 is a chart displaying elevated temperature (250° C.) tensile strength for unmodified 319 Al at different heat treatments in accordance with an example of the present invention.

Referring now to FIGS. 1 and 2, tensile strength is plotted for several samples of Al—Si alloys with varying Si and Sr content. FIG. 1 show room temperature tensile strength while FIG. 2 shows elevated temperature (250° C.). Overall, the elevated temperature tensile strength drops significantly for each heat treatment. More telling is that the solution treated castings (T6 and T61-2) lost significantly more elevated temperature strength than the precipitation treated only or as-cast castings (AC, T52, T56).

Figure 3:
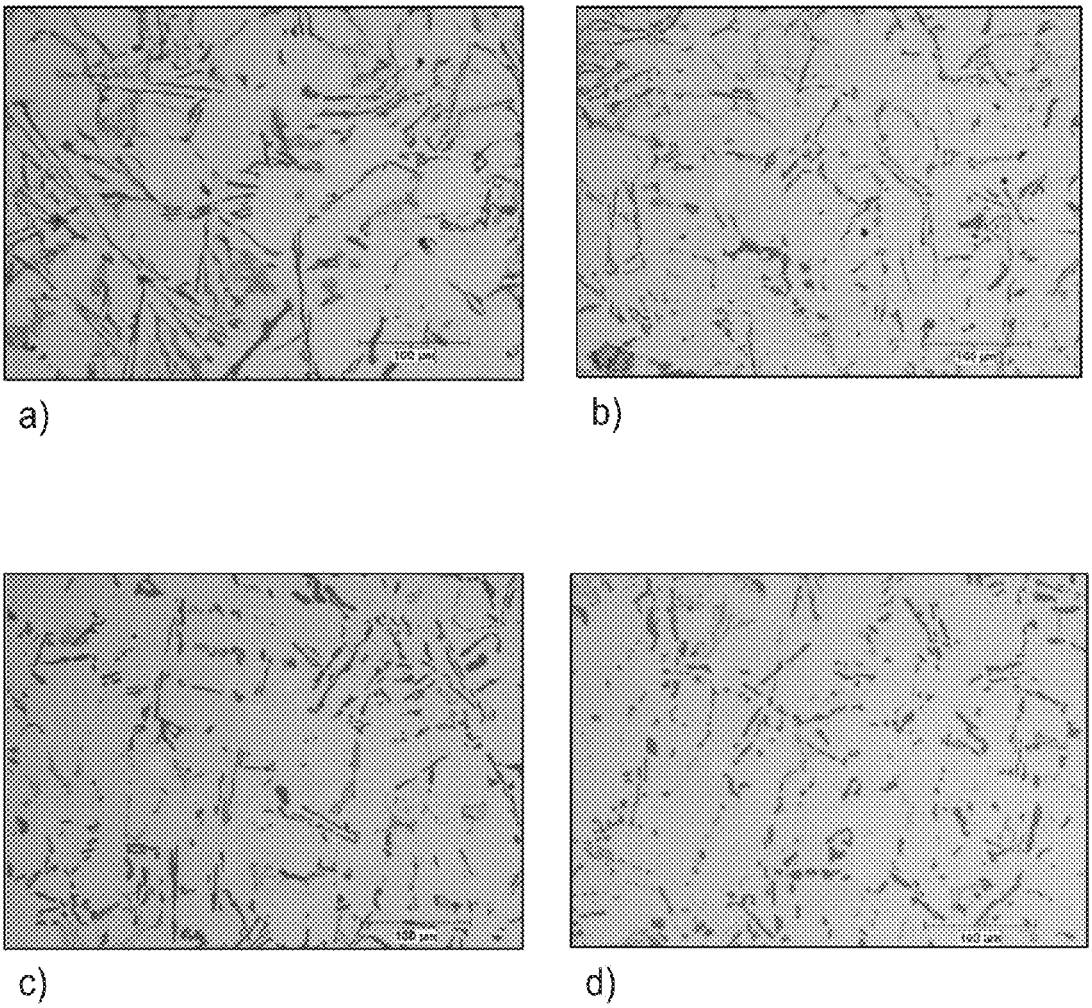
FIG. 3 is a series of micrographs of various Aluminum-Silicon castings in accordance with the present invention.

With reference to FIG. 3, unmodified 319 Al micrographs display the changes in morphology of the eutectic silicon particles due to elevated temperature exposure through solution heat treating at 495° C. The as-cast sample a) reflects the plate-like eutectic silicon. After one hour of solution time b), the eutectic silicon particle size decreases with some rounding of the ends of the particles. As solution time increases c) and d), particle size continues to decrease while the eutectic silicon particle shape is noticably more rounded as spheroidization continues.

Figure 4:
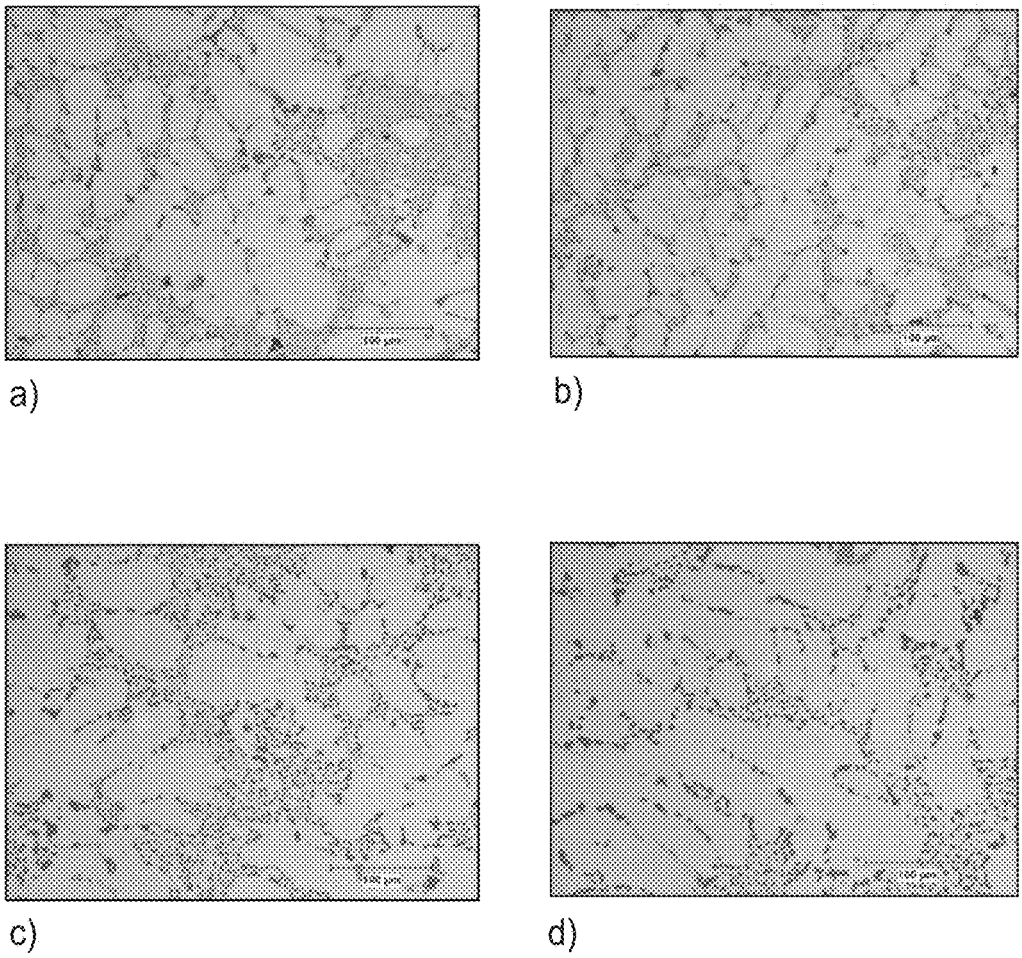
FIG. 4 is a series of micrographs of various Aluminum-Silicon castings in accordance with the present invention.

Next, FIG. 4 includes micrographs for Strontium modified 319 Al microstructure after solution heat treat for a) as cast, b) 1 hour, c) 16 hours, and d) 48 hours. Strontium modification and high cooling rate results in fine particle eutectic silicon in the as cast state a). At the start of solution treatment, after one hour b) particle size decreases. However, as solution time increases to 16 c) and 48 hours d), particle size coarsens and becomes more rounded.

As can be concluded from the above results, solution treatment of unmodified and Strontium modified 319 Al tends towards a similar microstructure of coarse, rounded eutectic Silicon. However, 48 hours is too long for commercial production of castings. A path to the microstructure achieved at 48 hours of solution treatment must be created.

In the continued search for stable aluminum castings in high temperature service environment, the effects of both composition modification and solution temperature on microstructure is examined. Table 1 below provides the compositions of a 319 Al with Manganese (Mn), 319 Al with Mn modified with Strontium (Sr), and 319 Al with Mn modified with higher levels of Iron (Fe).

TABLE 1

Sample composition for 319 Al with modifications. 319 Al + Mn, 319 Al + Mn + Sr, and 319 Al + Mn + Fe.

| | Si | Fe | Cu | Mn | Mg | Zn | B | Ti | Sr | SG |
|---|---|---|---|---|---|---|---|---|---|---|
| 319 + Mn | 7.890 | 0.228 | 3.910 | 0.426 | 0.304 | 0.095 | 0.001 | 0.130 | 0.000 | 2.720 |
| 319 + Mn + Sr | 7.730 | 0.214 | 4.050 | 0.421 | 0.292 | 0.065 | 0.000 | 0.144 | 0.009 | 2.710 |
| 319 + Mn + Fe | 7.860 | 0.405 | 3.770 | 0.459 | 0.283 | 0.100 | 0.001 | 0.124 | 0.000 | 2.700 |

TABLE 2

Sample solution heat treatment steps and temperatures.

| Heat Treat | 495° C. | 515° C. | 530° C. | 540° C. | 555° C. | Age |
|---|---|---|---|---|---|---|
| As Cast | none | none | none | none | none | none |
| T6 | 8:00 hr | | | | | 180° C. 8:00 hr |
| T61 | 3:00 hr | 5:00 hr | | | | 180° C. 8:00 hr |
| T62 | 3:00 hr | 3:00 hr | 2:00 hr | | | 180° C. 8:00 hr |
| T63 | 3:00 hr | 2:00 hr | 2:00 hr | 1:00 hr | | 180° C. 8:00 hr |
| T64 | 3:00 hr | 2:00 hr | 1:00 hr | 1:00 hr | 1:00 hr | 180° C. 8:00 hr |

Figure 5:
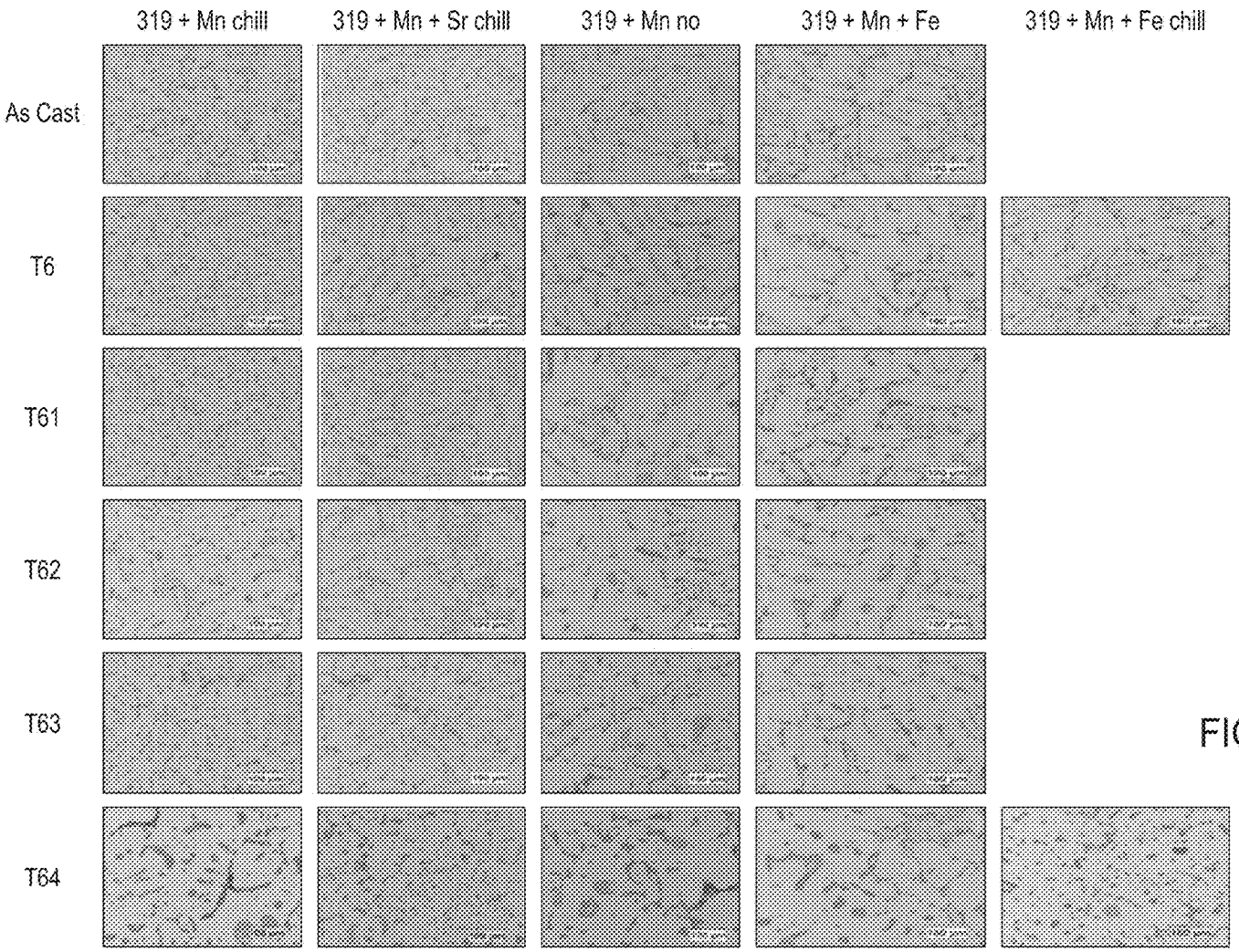
FIG. 5 is a is a series of micrographs of various Aluminum-Silicon castings in accordance with the present invention.
Figure 6:
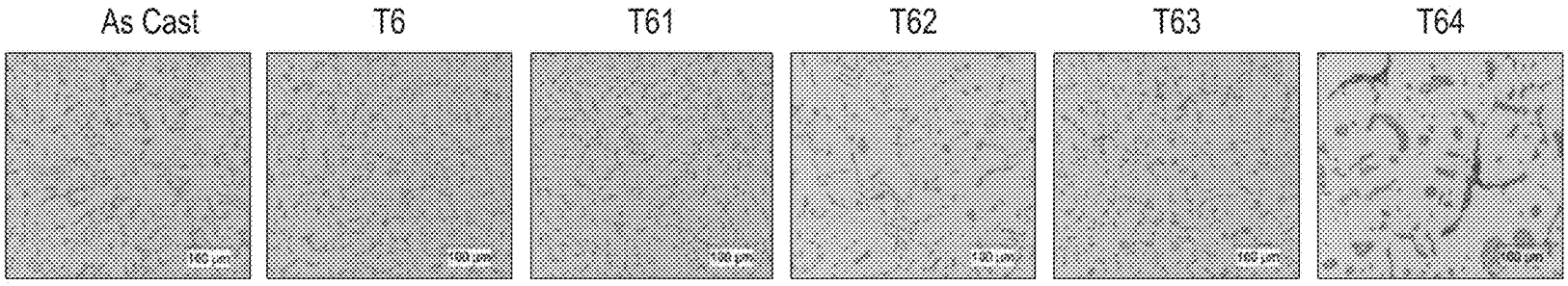
FIG. 6 is a series of micrographs of various Aluminum-Silicon castings in accordance with the present invention.

With reference to FIGS. 5 and 6, the resulting micrographs are displayed from the samples modified with compositions from Table 1 and solution heat treated at durations and temperatures of Table 2. As can be seen, when the maximum solution temperature exceeds 515° C. the rounding of the eutectic silicon particles is accelerated. An estimate is given that for every 10° C. increase in temperature the required time for rounding of particles is halved. However, as can be seen in FIG. 6, the T64 solution heat treatment, incipient melting has occurred. Thus raising the solution temperature to 555° C. resulted in a detrimental reaction. Still, a development of note is that the average size of the silicon particles initially decrease to a minimum limit before beginning a coarsening process. This coarsening process continues until the 540° C. minimum before incipient melting overtakes the coarsening process. Additionally, regarding the Fe modification, the Fe containing insoluble intermetallic particles are rounding and fragmenting into smaller particles as the solution temperature is increased. This opens the possibility of incipient melt-free microstructures at higher temperatures; at least up to the eutectic temperature.

Figure 7:
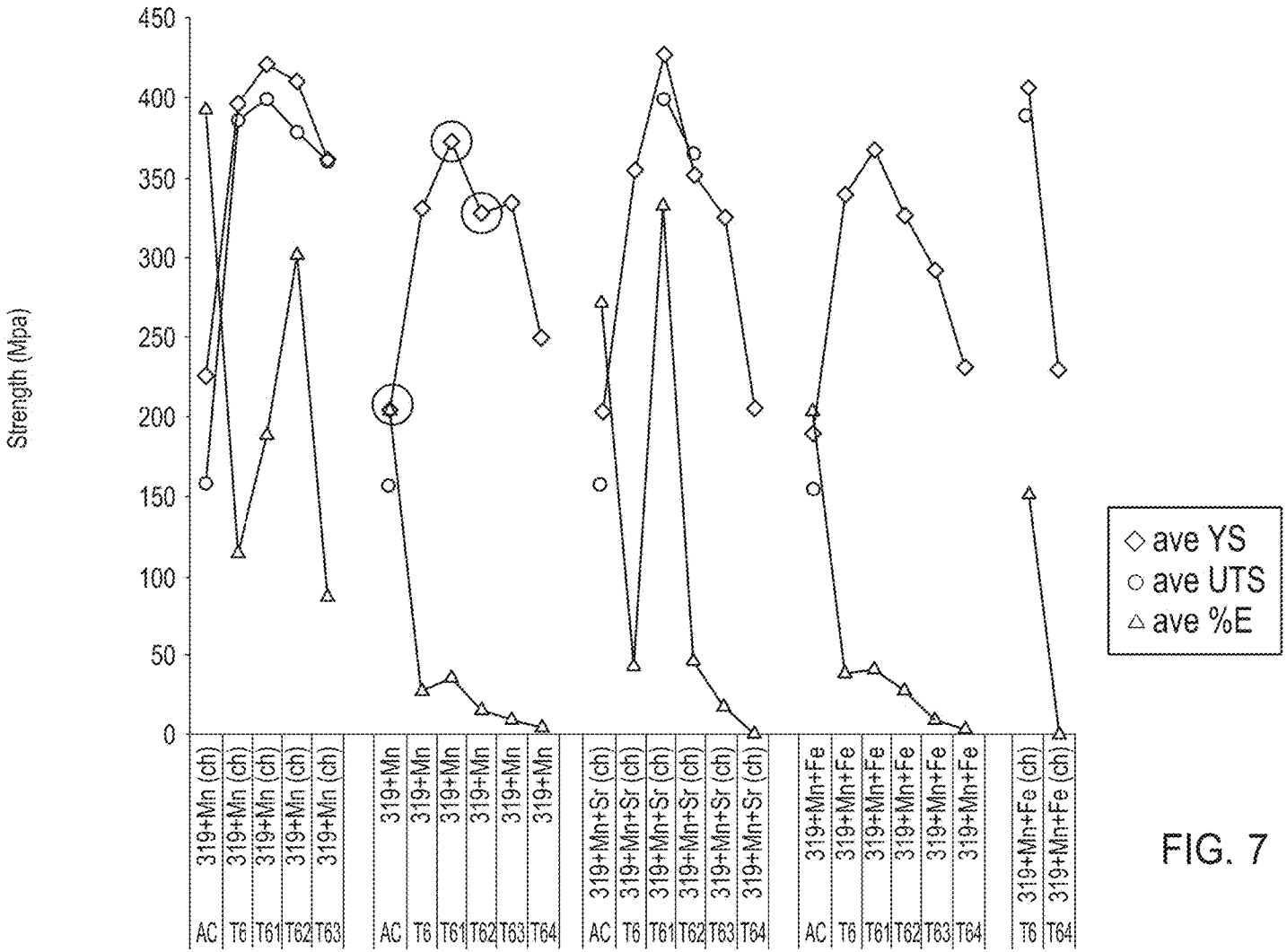
FIG. 7 is a chart displaying room temperature tensile strength of the unmodified 319 Al, Fe modified 319 Al, and Sr modified 319 Al processed through a heat treatment in accordance with an example of the present invention.
Figure 8:
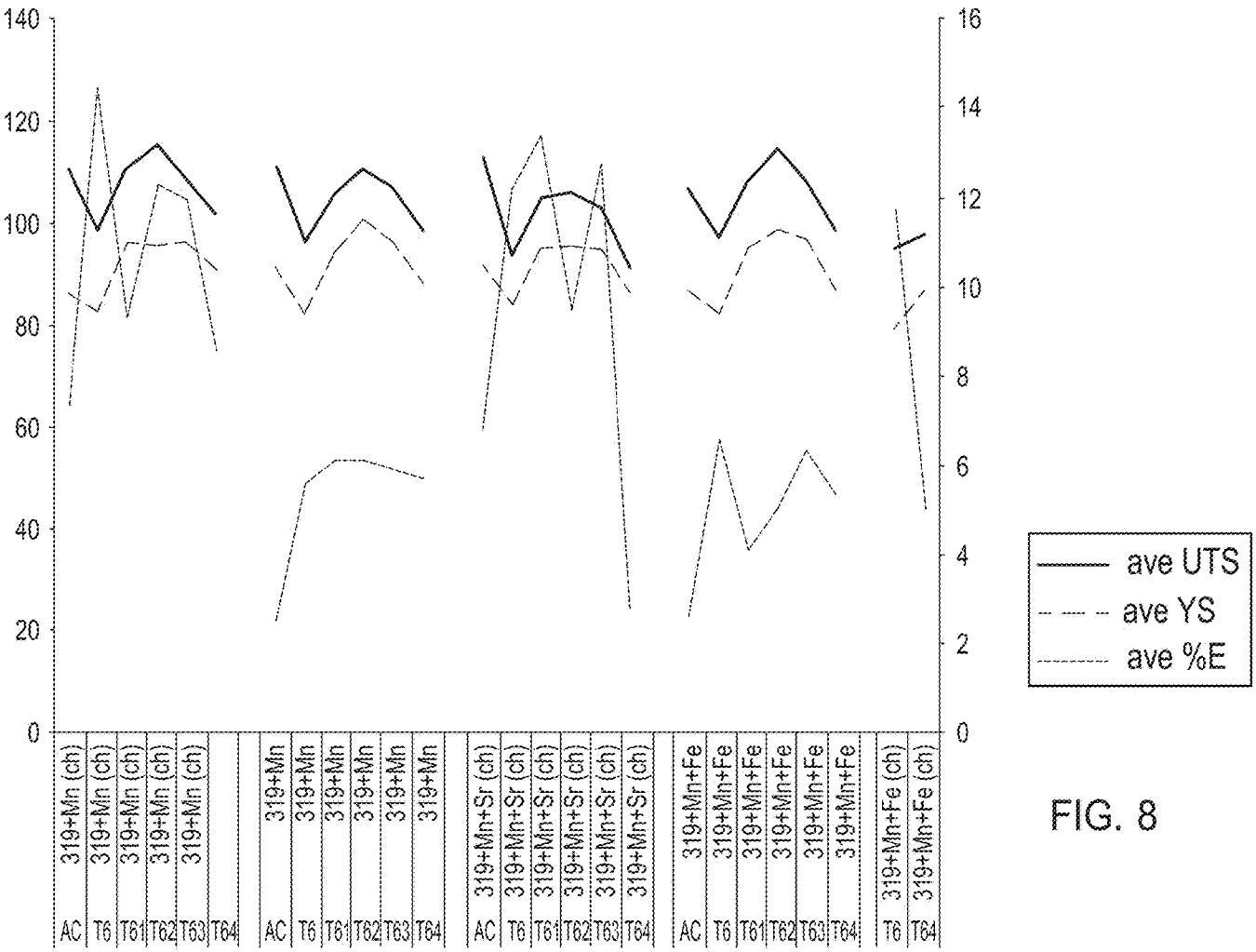
FIG. 8 is a chart displaying room temperature tensile strength of the unmodified 319 Al, Fe modified 319 Al, and Sr modified 319 Al of Table 1 processed through a heat treatment in accordance with an example of the present invention.

Tensile strengths from the samples of FIGS. 5 and 6 are charted in FIGS. 7 and 8. Of note, the room temperature peak strength results from the T61 solution heat treatment.

Tensile strength of samples from Tables 1 and 2 that were subsequently stabilized for 200 hours at 250° C. are charted in FIG. 8. The As Cast microstructure exhibits the best strength retention, however, the high temperature strength also begins to improve as the maximum solution temperature is increased leading to a coarsening of the second phase particles.

The larger quantity of hard particles in the microstructure, the aggregate hardness and strength increases; especially at elevated temperature where the hardness and strength of the aluminum matrix drop rapidly. Soluble phases such as soluble intermetallics and strengthening precipitates add very little to the hardness and strength after long-term elevated temperature exposure. However, soluble intermetallics and strengthening precipitates are very helpful during fabrication. For example, machining forces and tool wear are generally lower for higher hardness aluminum castings. Thus, retaining a minimum degree of hardening is necessary to aid in manufacturing the machined casting. Regarding long-term durability in an elevated temperature or cycling temperature environment, an optimum volume fraction of hard particles is required that balance hardness and strength against ductility and fatigue resistance. The optimum volume fraction is not fixed for every casting design application in that loading, design geometry, in-service temperature, and heating rates all contribute to determining the optimum volume fraction. In addition, the type of hard particle, including the hardness, size, shape, spacing and interfacial bonding to the matrix also contribute to the information required to specify the optimum volume fraction of hard particles.

As a result, a minimum level of precipitation hardening is required. In aluminum-silicon casting alloys adequate hardness can be developed with magnesium above 0.25% or copper above 1.5% or some combination of the two. Keeping Mg and Cu as low as practical is important since higher levels lead to the formation of soluble intermetallics that will reduce casting quality and impair the heat treatment process proposed below via the threat of incipient melting.

Additionally, the volume fraction, size, and distribution of insoluble hard phases, both eutectic silicon and intermetallic, must be controlled to a close tolerance. This is accomplished by chemistry modification to suit the local solidification conditions during the primary casting process. The volume fraction of these phases are not changed by subsequent thermal processing; only the shape and size and so it is favorable to produce the right amount in the initial microstructure. For high temperature applications, the alloy includes Silicon in the amount between 5.0% and 17.0% by weight, Iron in the amount between 0.0% and 0.9% by weight, Manganese in the amount between 0.0% and 1.0% by weight, Chromium in the amount between 0.0% and 0.3% by weight, and Nickle in the amount between 0.0% and 2.0% by weight.

Next, optimization of the heat treatment process produces the size, shape and volume fraction of insoluble hard particles specified to the application. Commercial alloys can show improved elevated-temperature strength when they have not been solution treated due to a significant fraction of the hard phases being soluble and thus disappear during solutionizing. In addition, current solution treatment processes have been optimized to minimize the eutectic silicon size in order to maximize ductility. However, for elevated temperature strength, slightly larger particle sizes are required. Thus under-solution treating an alloy with a fairly good morphological control of the insoluble intermetallics at an optimum volume fraction is one possible process to use. Alternatively, a super-critical solution treatment by stepping the temperature to levels that allow the eutectic silicon to grow past the minimum while simultaneously refining and speriodizing the insoluble intermetallic phases is another possible process. Once the shape and size of the hard particles is defined by the solution treatment process, subsequent thermal exposure during aging and in service will have little effect on the properties. Therefore, maintaining a stable structure and properties that will define the minimum hardness and strength attained is the target of the process once the hardening precipitates have become incoherent.

Alloy composition, casting process and heat treatment method are controlled to form an aluminum casting with insoluble intermetallic phases that are refined and spheroidized. Whereas the intermetallic phases are primarily iron-based, they can contain Mn, Cr, Ni, etc. as minor impurities. The intermetallic phases are included at less than 2 to 3 volume percent for applications requiring room-temperature toughness, or 6 to 10 volume percent for high stiffness applications. The eutectic silicon phase is stabilized beyond the minimum particle size and spheroidized via fragmentation of unmodified structures or agglomeration of modified structures. Particle size of hard particles is ideally between 50 and 110 microns (equivalent circle diameter (μm)=$\sqrt{4A/\pi}$, with A as the measured area of the particle) with particle shape approaching spheroidal. The eutectic silicon phase is included as about 6 to 12 volume percent for high toughness applications and from 6 to 15 volume percent for higher stiffness applications.

Thus, Table 3 details alloy compositions for different applications; including moderate or high temperature and high or low toughness.

TABLE 3

Chemistry compositions for moderate or high temperature, low or high toughness applications. Chemistry Modifications Based on Application - % Weight

| | | Application | | | |
|---|---|---|---|---|---|
| Effect on Microstructure | Element | Moderate Temp/ High Toughness | Moderate Temperature/ Lower toughness | High Temperature/ High Toughness | High Temperature/ Lower Toughness |
| Primary Hard | Si | 1-9 | 1-11 | 5-14 | 5-17 |
| Particle | Fe | 0-0.5 | 0-0.8 | 0-0.6 | 0-0.9 |
| Formers | Mn | 0-0.6 | 0-0.8 | 0-0.0.7 | 0-1.0 |
| | Cr | 0-0.01 | 0-0.02 | 0-0.1 | 0-0.3 |
| | Ni | 0-0.2 | 0-0.3 | 0-0.7 | 0-2.0 |
| Solid Solution | Zn | 0-1 | 0-1 | 0-0.5 | 0-0.5 |
| Lower temperature | Cu | 0-2.0 | 0-3.5 | 0-1.25 | 0-2.0 |
| precipitates | Mg | 0-0.4 | 0-0.5 | 0-0.4 | 0-0.5 |

TABLE 3-continued

Chemistry compositions for moderate or high temperature, low or high toughness applications.
Chemistry Modifications Based on Application - % Weight

| Effect on Microstructure | Element | Application: Moderate Temp/ High Toughness | Moderate Temperature/ Lower toughness | High Temperature/ High Toughness | High Temperature/ Lower Toughness |
|---|---|---|---|---|---|
| Precipitate Stabilizers, Grain Refiners | Ti | 0.1-0.2 | 0.1-0.25 | 0.1-0.3 | 0.1-0.45 |
| | V | 0-0.1 | 0-0.2 | 0-0.3 | 0-0.45 |
| | Zr | 0-0.25 | 0-0.3 | 0-0.4 | 0-0.5 |
| | B | 0.01-0.02 | 0.01-0.03 | 0.01-0.05 | 0.01-0.1 |
| Primary Hard Particle Morphology Modifiers | La | 0-1.0 | 0-2.0 | 0-1.0 | 0-2.0 |
| | Sr | 0-0.012 | 0-0.018 | 0-0.012 | 0-0.018 |
| Modifies Lower Temp precipitation process | Sn | 0-0.1 | 0-0.15 | 0-0.1 | 0-0.15 |
| 'tramp' elements | others | 0-0.05 | 0-0.04 | 0-0.05 | 0-0.04 |

In addition to the composition guidelines of Table 3, Table 4 includes guidelines for optimal microstructure features for each of the applications.

TABLE 4

Ideal microstructure features for moderate or high temperature, low or high toughness applications.
Optimal Microstructure Features

| | | | | | |
|---|---|---|---|---|---|
| Silicon Particle Size | μm | 30-60 | 30-70 | 50-80 | 50-110 |
| Silicon Volume Percent | % | 5-6 | 5-8 | 6-12 | 6-15 |
| Insoluble Intermetallic Particle Size | μm | 30-55 | 30-80 | 50-65 | 55-75 |
| Insoluble Intermetallic Volume Percent | % | 2-3 | 2.5-4.5 | 4-7 | 6-10 |

While the best modes for carrying out the invention have been described in detail, those familiar with the art to which this invention relates will recognize various alternative designs and examples for practicing the invention within the scope of the appended claims.

The following is claimed:

1. An Aluminum-Silicon alloy based casting method, the casting method comprising:

providing an Aluminum-Silicon alloy having a composition including, by weight percentage:

from about 5.00% to about 17.00% Silicon (Si);

from about 0.00% to about 0.90% Iron (Fe);

from about 0.00% to about 1.00% Manganese (Mn);

from about 0.000% to about 0.018% Strontium (Sr);

from about 0.00% to about 2.00% Copper (Cu);

from about 0.00% to about 0.50% Magnesium (Mg);

from about 0.00% to about 0.05% Zinc (Zn);

from about 0.01% to about 0.10% Boron (B); and a balance of Aluminum (Al);

producing a casting using the Aluminum-Silicon alloy by means of one of a sand casting process, a permanent mold casting process, a semi-permanent mold casting process, a high-pressure die casting process, a squeeze casting process, and lost foam casting process;

analyzing the casting to determine an as-cast silicon particle volume fraction, an average silicon particle size, an insoluble intermetallic particle volume fraction, and an insoluble intermetallic average particle size; and solution treating the casting to above an incipient melting temperature, solution treating comprising:

heating the casting to about 495° C. for about three hours;

heating the casting to about 515° C. for about three hours; and heating the casting to about 530° C. for about two hours.

2. The Aluminum-Silicon alloy based casting method of claim 1 wherein providing an Aluminum-Silicon alloy further comprises providing the Aluminum-Silicon alloy having a composition including, by weight percentage, from about 7.85% to about 7.90% Silicon and from about 0.20% to about 0.30% Iron.

3. The Aluminum-Silicon alloy based casting method of claim 2 wherein providing an Aluminum-Silicon alloy further comprises providing the Aluminum-Silicon alloy having a composition including, by weight percentage, about 0.00% Strontium.

4. The Aluminum-Silicon alloy based casting method of claim 2 wherein providing an Aluminum-Silicon alloy further comprises providing the Aluminum-Silicon alloy having a composition including, by weight percentage, about 0.009% Strontium.

5. The Aluminum-Silicon alloy based casting method of claim 1 wherein providing an Aluminum-Silicon alloy further comprises providing the Aluminum-Silicon alloy having a composition including, by weight percentage, from about 0.30% to about 0.41% Iron and about 0.00% Strontium.

6. The Aluminum-Silicon alloy based casting method of claim 1 wherein providing an Aluminum-Silicon alloy further comprises providing the Aluminum-Silicon alloy having a composition including, by weight percentage, more than about 0.25% Magnesium.

7. The Aluminum-Silicon alloy based casting method of claim 1 wherein providing an Aluminum-Silicon alloy further comprises providing the Aluminum-Silicon alloy having a composition including, by weight percentage, more than about 1.50% Copper.

8. The Aluminum-Silicon alloy based casting method of claim 1 further comprising solution treating the casting to above an incipient melting temperature, solution treating comprising:

heating the casting to a first temperature for a first period of time;

heating the casting to a second temperature for a second period of time; and heating the casting to a third temperature for a third period do time.

9. The Aluminum-Silicon alloy based casting method of claim 8 further comprising aging the casting at a temperature between about 150° C. and 190° C. and a time of about 6 to 10 hours.

10. An Aluminum-Silicon alloy based casting method, the casting method comprising:

providing an Aluminum-Silicon alloy having a composition including, by weight percentage:

from about 5.00% to about 17.00% Silicon (Si);

from about 0.00% to about 0.90% Iron (Fe);

from about 0.00% to about 1.00% Manganese (Mn);

from about 0.000% to about 0.018% Strontium (Sr);

from about 0.00% to about 2.00% Copper (Cu);

from about 0.00% to about 0.50% Magnesium (Mg);

from about 0.00% to about 0.05% Zinc (Zn);

from about 0.01% to about 0.10% Boron (B); and a balance of Aluminum (Al), and casting a part using the Aluminum-Silicon alloy;

solution treating the part by heating the part to 495° C. for about three hours, heating the part to 515° C. for about three hours, heating the part to 530° C. for about two hours; and aging the part at a temperature between about 150° C. and 190° C. and a time of about 6 to 10 hours.

* * * * *